US009186000B1

(12) United States Patent
Dominguez

(10) Patent No.: US 9,186,000 B1
(45) Date of Patent: Nov. 17, 2015

(54) DEVICE TO STORE AND DISPLAY MESSAGES

(71) Applicant: Dianne Parry Dominguez, Topanga, CA (US)

(72) Inventor: Dianne Parry Dominguez, Topanga, CA (US)

(73) Assignee: Malibu Design Studio, LLC, Topanga, CA (US)

( * ) Notice: Subject to any disclaimer, the term of this patent is extended or adjusted under 35 U.S.C. 154(b) by 0 days.

(21) Appl. No.: 14/682,933

(22) Filed: Apr. 9, 2015

Related U.S. Application Data

(60) Provisional application No. 61/977,927, filed on Apr. 10, 2014.

(51) Int. Cl.
*A47G 1/06* (2006.01)

(52) U.S. Cl.
CPC ..... *A47G 1/0638* (2013.01); *A47G 2001/0672* (2013.01); *A47G 2001/0688* (2013.01)

(58) Field of Classification Search
CPC ..... A47G 1/0638; A47G 2001/0672; A47G 2001/145; G09F 1/12
See application file for complete search history.

(56) References Cited

U.S. PATENT DOCUMENTS

| | | | | |
|---|---|---|---|---|
| 2,887,804 | A * | 5/1959 | Wise | 40/711 |
| 4,195,729 | A * | 4/1980 | Macken | 206/216 |
| 4,380,292 | A * | 4/1983 | Cramer | 206/366 |
| 4,534,126 | A * | 8/1985 | Gilman | 40/661 |
| 5,226,252 | A * | 7/1993 | Haluska | 40/634 |
| 5,450,926 | A * | 9/1995 | Fraser | 186/59 |
| 5,894,948 | A * | 4/1999 | Yeh | 215/12.1 |
| 5,933,994 | A * | 8/1999 | Misaresh | 40/649 |
| 7,234,258 | B2 * | 6/2007 | Nielson | 40/661 |
| 2006/0185210 | A1 * | 8/2006 | Beigel | 40/711 |

* cited by examiner

*Primary Examiner* — Gary Hoge

(57) ABSTRACT

A keepsake device that is capable storing and displaying fortune cookie papers and printed messages. The device has an outer sleeve that is at least partially transparent and is attachable to and detachable from an inner sleeve to allow insertion and removal of the contents. The device also has a compartment which acts as a storage area for fortune cookie papers and printed messages. The device is shaped so that it can be displayed on a flat surface such as a table top and contains a magnet for attaching the device to a magnetizable surface.

11 Claims, 7 Drawing Sheets

DEVICE TO STORE AND DISPLAY MESSAGES

CROSS-REFERENCE TO RELATED APPLICATIONS

This application claims the benefit of U.S. Provisional Application No. 61/977,927, filed Apr. 10, 2014.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates to fortune cookies.

More particularly, the present invention is a device to store and display fortune cookie papers, or other printed messages.

Fortune cookies include an internal "fortune" message printed on paper for the consumer who opens the fortune cookie to find and enjoy. Sharing the written predictions or fortunes contained therein is a well-established and rich tradition. Consumers often save these fortune cookie papers as keepsakes, but there are currently no readily made devices available that allow the consumer to display and store them in a way that is aesthetically pleasing. Traditionally consumers have tacked fortune papers to a bulletin board, placed in a wallet or kept in a drawer, thereby not allowing the possibility a visually pleasing way to display and organize these fortune cookie messages. The present invention eliminates the above described problems.

In an alternative embodiment, the paper may have a printed message that did not originate from a fortune cookie.

SUMMARY OF THE INVENTION

The present invention is a multipurpose ornamental keepsake device that is capable of displaying fortune papers on a flat surface such as a table top or by adhesion to a magnetizable surface and also acts as a storage unit for fortune papers and printed messages.

The broken lines showing a fortune cookie paper insert in FIG. 1, FIG. 2, FIG. 3, FIG. 4, FIG. 5, FIG. 6 and FIG. 8 are included for the purpose of illustrating the invention in use, and form no part of the claimed design.

DETAILED DESCRIPTION OF THE INVENTION

A number of terms are used herein for clarity and ease of exposition. For example, the term "consumer" is used to refer to a person who purchases and/or is involved in using the device.

The term "sleeve" is used to refer to a part that fits over or around something to protect it or to hold its parts together.

The term "face" is used to refer to a surface of a thing.

The term "component" is used to refer to a part or element of a larger whole, specifically two parts of the device.

The term "material" is used to refer to the matter from which a thing is made.

Figure 1:
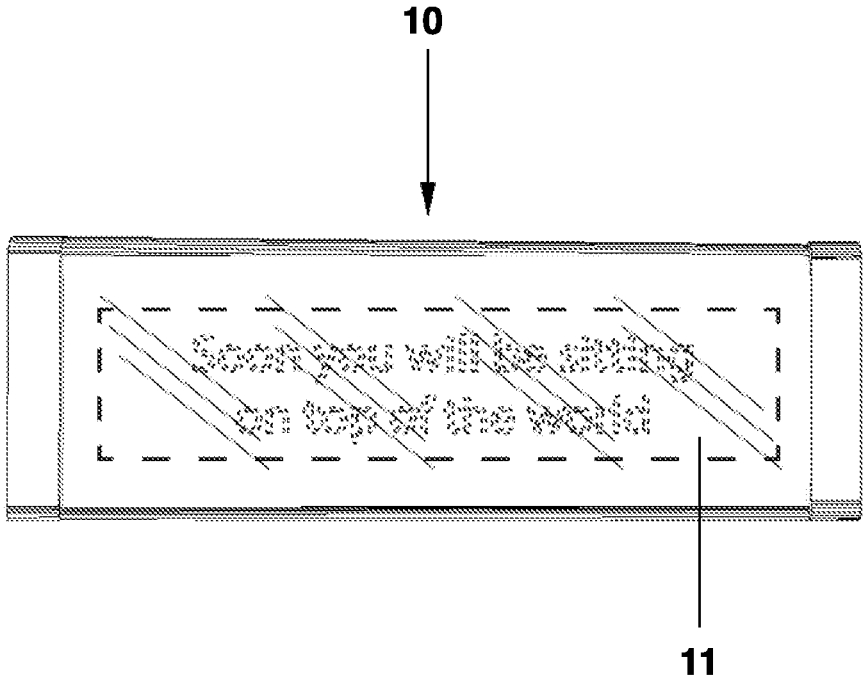
FIG. 1 is a front view of a device to store and display messages of the present invention, illustrated in a closed configuration.

Referring now to the invention in more detail, in FIG. 1, the device 10 is shown in a closed configuration with a fortune paper 11 in place.

Figure 2:
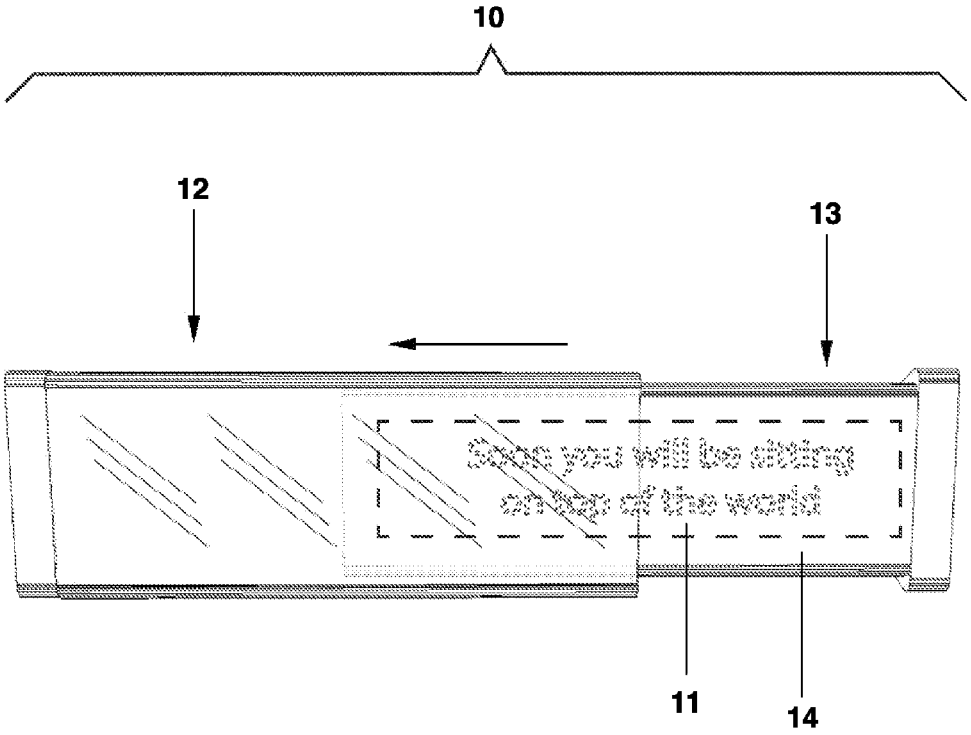
FIG. 2 is a front view of a device to store and display messages of the present invention, illustrated in a partially open configuration.
Figure 8:
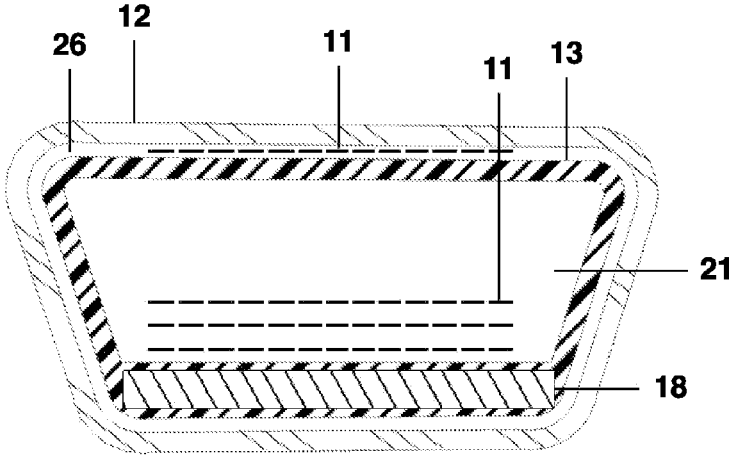
FIG. 8 is an elevational view taken on lines 8-8 of FIG. 7.

FIG. 2 illustrates the two main components of the device 10 which consists of an inner sleeve 13 which has a flat face 14 to place the fortune paper 11. The second main component of the device 10 is the outer sleeve 12. The outer sleeve 12 slides apart from the inner sleeve 13 to allow the consumer to have access to the fortune paper 11 in order to change or remove it. When the device 10 is in a closed configuration, as shown in FIG. 1, the outer sleeve 12 covers the inner sleeve 13 and acts to hold the fortune paper 11 in place. The elevational view shown in FIG. 8 shows that the depth of the inner sleeve 13 is less than the depth of the outer sleeve 12 which creates a gap 26 in which the fortune paper 11 can reside.

Figure 3:
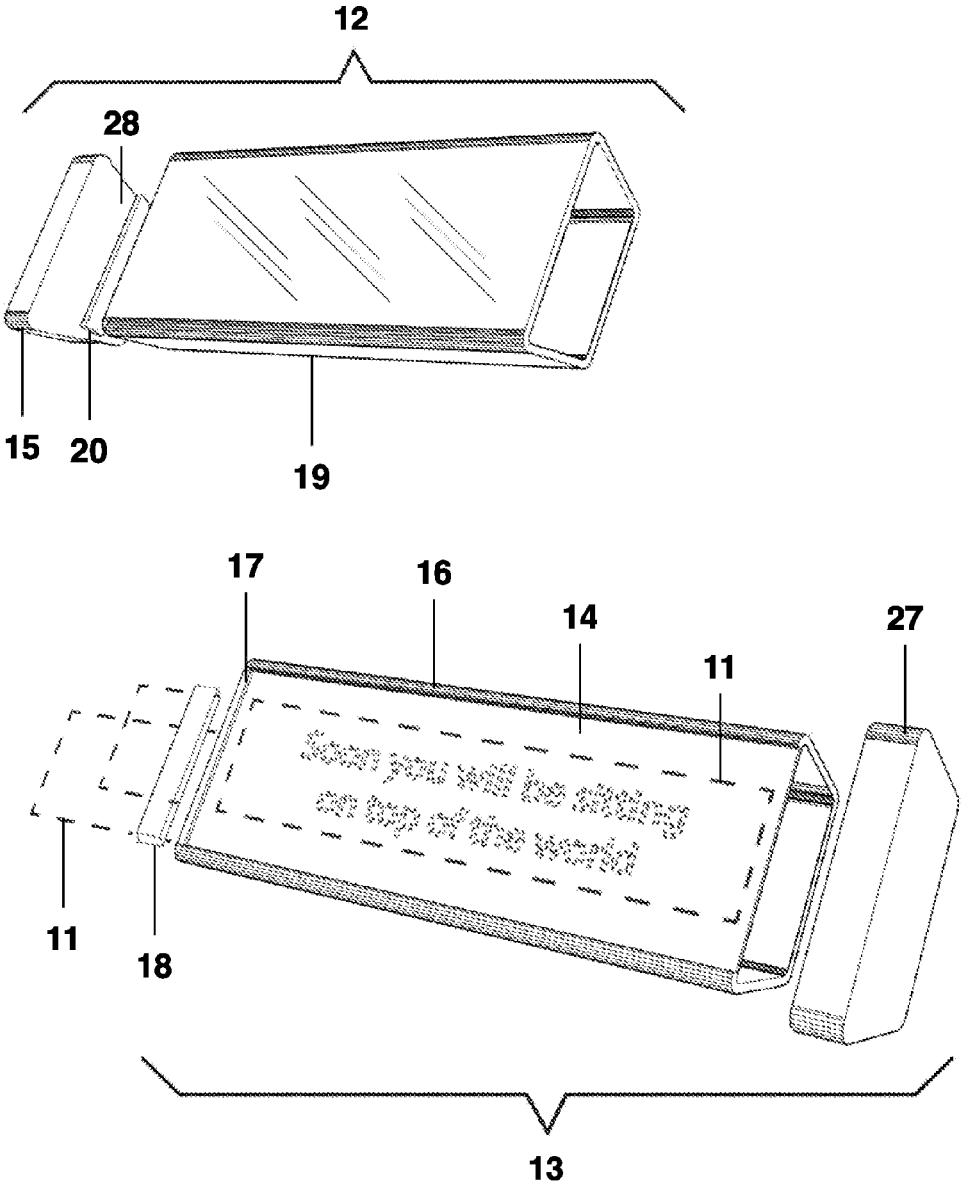
FIG. 3 is an exploded perspective view of a device to store and display messages of the present invention.

In more detail, FIG. 3 is an exploded perspective view showing the two main components of the device 10. The inner sleeve 13 consists of an end cap 27 attached to a hollow tube 16 which has a flat face 14 on which to place the fortune paper 11. The face 14 of the hollow tube 16 which is part of the inner sleeve 13 has a raised edge 17 at the end which acts to hold the fortune paper 11 in place and prevents it from sliding off to the side when opening or closing the device 10. There is a magnet 18 located at the end of the hollow tube 16, towards the back side 23 of the device 10. The second main component is the outer sleeve 12 which consists of a transparent cover 19 attached to an end cap 15. The inner face 28 of the end cap 15 contains an embedded magnet 20 so that when the inner sleeve 13 is inserted into the outer sleeve 12, the magnet 18 which is embedded in the hollow tube 16 will be drawn toward the magnet 20 in the end cap 15 and will secure the device 10 in a closed configuration.

The construction details of the invention as shown in FIG. 1, FIG. 2 and FIG. 3 are that the inner sleeve 13 and end cap 15 and end cap 27 may be made of plastic, metal, resin, wood or of any other sufficiently rigid and strong material. The outer sleeve 12 may be made of any transparent material such as glass, plastic, or resin. Further, the various components of the device can be made of different materials.

Figure 4:
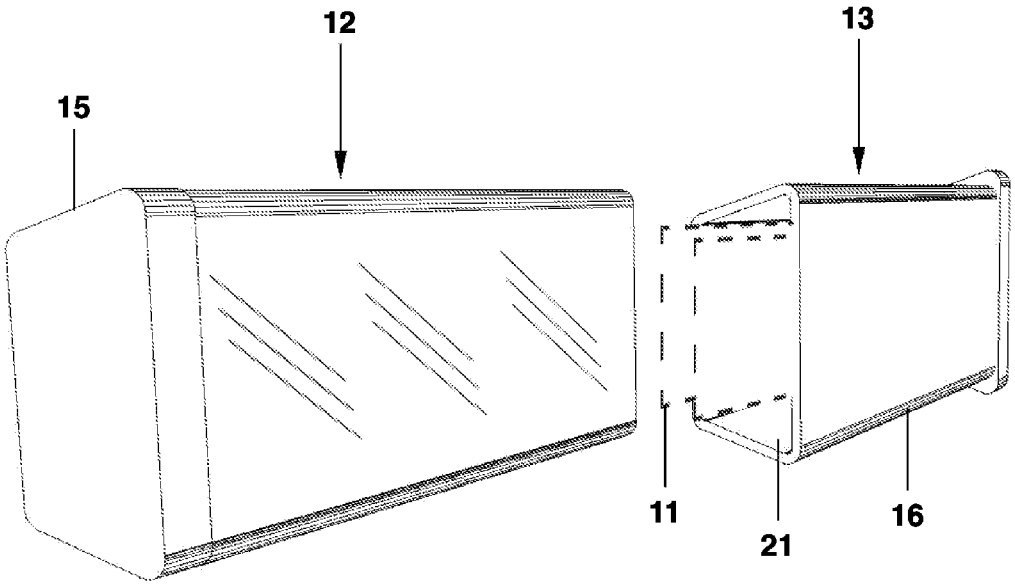
FIG. 4 is a left side perspective view of a device to store and display messages of the present invention, illustrated in an open configuration.

In more detail, FIG. 4 shows the left side view of the invention illustrated in an open position, with the outer sleeve 12 and the inner sleeve 13 as the two main components of the device 10. The inside of the hollow tube 16 of the inner sleeve 13 can be seen, which functions as a storage compartment 21 to store fortune cookie papers 11. In an alternative embodiment, the consumer may also store printed messages that did not originate from a fortune cookie. The cap 15 on the outer sleeve 12 covers the end of the hollow tube 16 and secures the contents in place when the device is in a closed configuration, as shown in FIG. 1.

Figure 5:
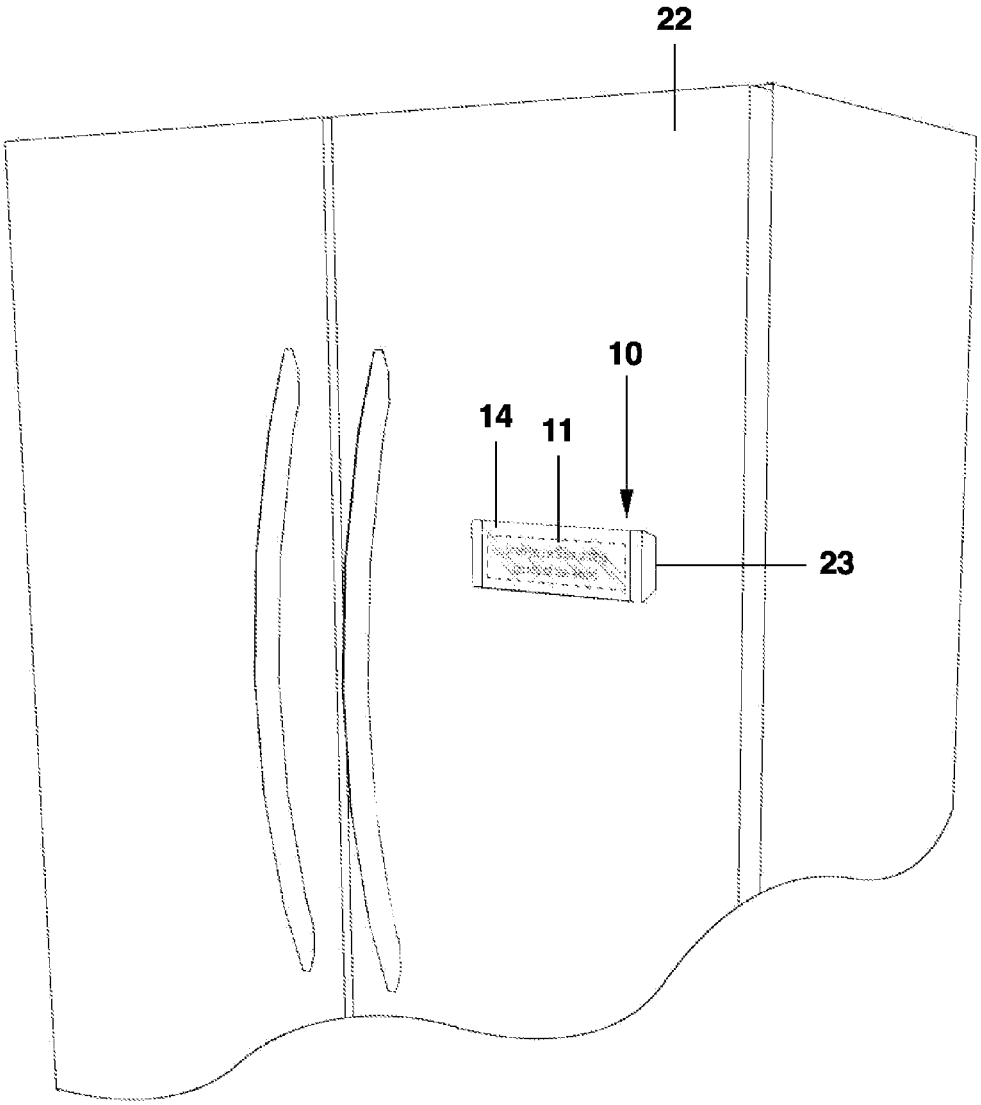
FIG. 5 is a perspective view of a refrigerator with a device to store and display messages mounted for display in accordance with the principals of the present invention.
Figure 9:
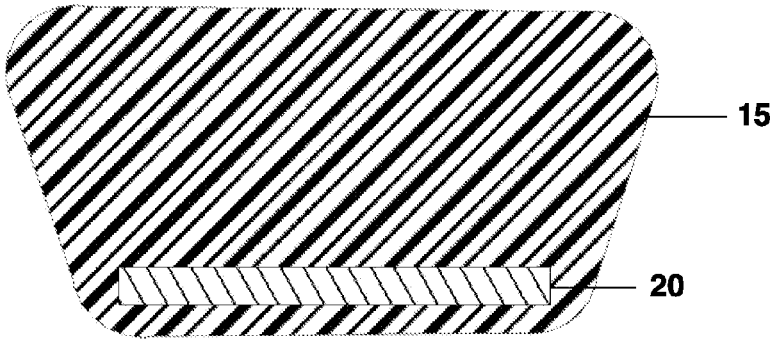
FIG. 9 is an elevational view taken on lines 9-9 of FIG. 7.

FIG. 5 illustrates how the device may adhere to a magnetizable surface, such as the vertical face of a refrigerator 22, by way of magnetic adhesion due to the magnet 18 embedded in the back side of the hollow tube 16 and the magnet 20 embedded in the end cap 15, as shown in FIG. 9. The fortune paper 11 is optimized for viewing on a vertical surface since the back side 23 of the device 10 is parallel to the front face 14 of the device 10.

Figure 6:
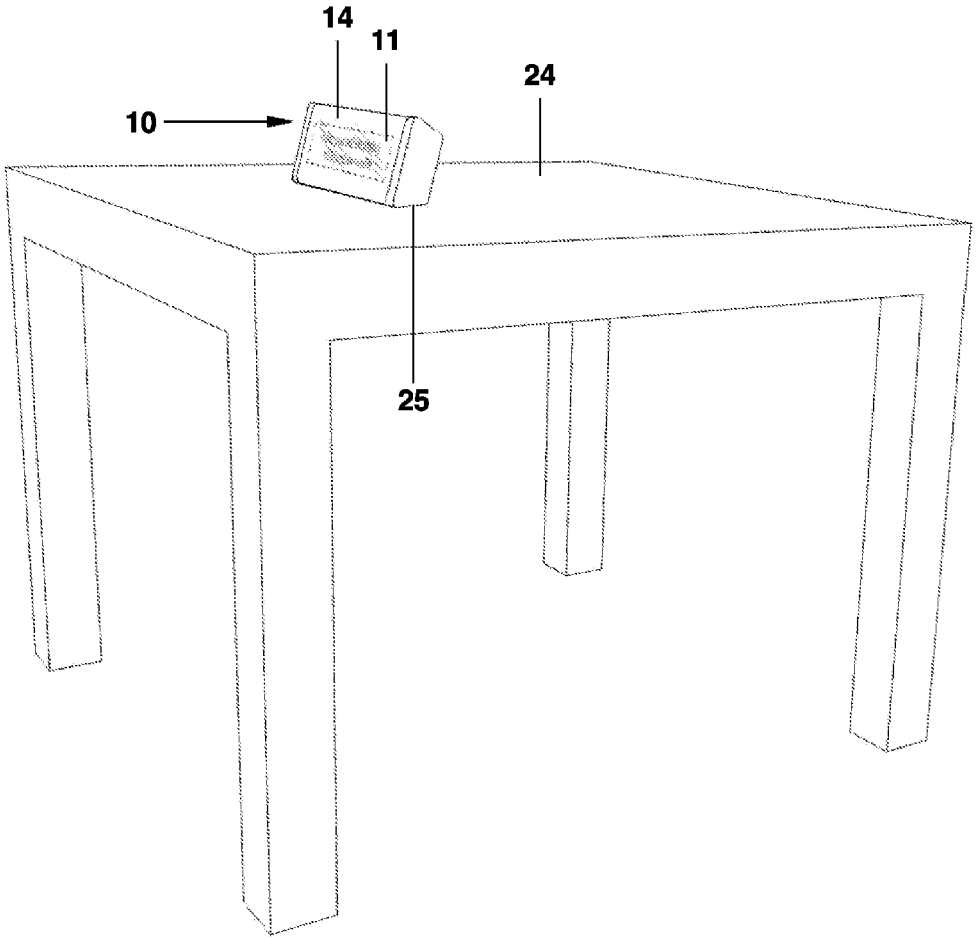
FIG. 6 is a perspective view of a table with a device to store and display messages for display in accordance with the principals of the present invention.
Figure 7:
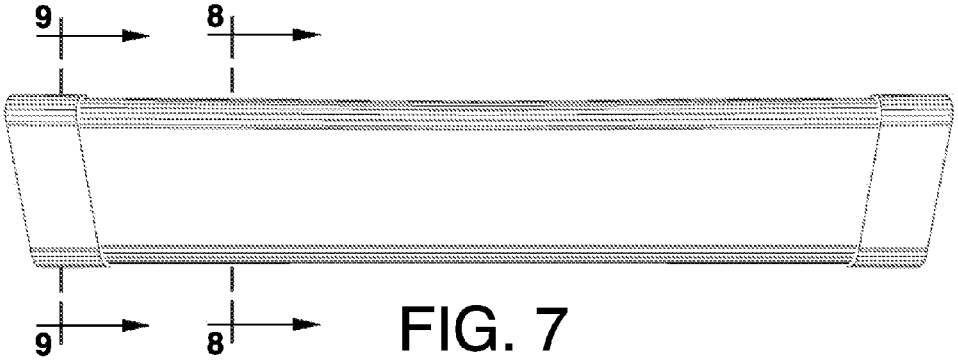
FIG. 7 is an enlarged long side view of the device of the present invention; illustrated in a closed configuration.

FIG. 6 illustrates how the device may be displayed on a flat (horizontal) surface such as a table top 24. The bottom side 25 of the device 10 is angled at approximately 30-degrees, which places the front face 14 of the device 10 at an angle that is optimized for viewing the fortune paper 11.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A keepsake device for holding and displaying fortune cookie papers and printed messages, comprising:

an outer sleeve, being at least partially transparent and having a first interior compartment, a first exterior surface, and an open side that provides access to the first interior compartment;

an inner sleeve, which has a second exterior surface on which to place a message to display and a second interior compartment in which to store messages, and wherein the outer sleeve encapsulates the inner sleeve when in a closed configuration to secure the contents in place;

inner ferromagnetic metal attached to the second exterior surface;

outer ferromagnetic metal attached to the first interior compartment and magnetically attracted to the inner ferromagnetic material when the inner sleeve is inside the outer sleeve.

2. The invention of claim 1 wherein the displayed message is visible when the device is resting on a horizontal surface.

3. The invention of claim 2 wherein the outer sleeve comprises a front face and a bottom face;

the displayed message is displayed through the front face;

the interior angle between the front face and the bottom face is between 50 degrees and 70 degrees.

4. The invention of claim 1 wherein the displayed message is visible when the device is magnetically secured to a vertical surface.

5. The invention of claim 4 wherein the inner ferromagnetic metal and the outer ferromagnetic metal are both permanent magnets.

6. The invention of claim 4 wherein the inner ferromagnetic metal is a permanent magnet and the outer ferromagnetic metal is not magnetized.

7. The invention of claim 4 wherein the outer ferromagnetic metal is a permanent magnet and the inner ferromagnetic metal is not magnetized.

8. The invention of claim 4 wherein the outer sleeve comprises a front face and a rear face;

the displayed message is displayed through the front face;

the rear face is parallel to the front face.

9. The invention of claim 1 wherein the inner ferromagnetic metal and the outer ferromagnetic metal are both permanent magnets.

10. The invention of claim 1 wherein the inner ferromagnetic metal is a permanent magnet and the outer ferromagnetic metal is not magnetized.

11. The invention of claim 1 wherein the outer ferromagnetic metal is a permanent magnet and the inner ferromagnetic metal is not magnetized.

* * * * *